United States Patent [19]

Kato et al.

[11] Patent Number: 4,968,572

[45] Date of Patent: Nov. 6, 1990

[54] ELECTROPHOTOGRAPHIC PHOTORECEPTOR WITH BINDER HAVING TERMINAL ACIDIC GROUP

[75] Inventors: Eiichi Kato; Kazuo Ishii, both of Shizuoka, Japan

[73] Assignee: Fuji Photo Film Co., Ltd., Kanagawa, Japan

[21] Appl. No.: 241,995

[22] Filed: Sep. 8, 1988

[30] Foreign Application Priority Data

| | | | |
|---|---|---|---|
| Sep. 11, 1987 | [JP] | Japan | 62-226696 |
| Oct. 30, 1987 | [JP] | Japan | 62-273547 |
| Oct. 30, 1987 | [JP] | Japan | 62-273548 |
| Dec. 25, 1987 | [JP] | Japan | 62-327409 |

[51] Int. Cl.[5] ..... G03G 5/087

[52] U.S. Cl. ..... 430/96

[58] Field of Search ..... 430/96

[56] References Cited

U.S. PATENT DOCUMENTS

| | | | |
|---|---|---|---|
| 4,105,448 | 8/1978 | Miyatuka et al. . | |
| 4,407,921 | 10/1983 | Bennett et al. | 430/96 |
| 4,517,271 | 5/1985 | Hirooka et al. | 430/96 X |

FOREIGN PATENT DOCUMENTS

| | | | |
|---|---|---|---|
| 49-9376 | 3/1974 | Japan | 430/96 |
| 50-36769 | 4/1975 | Japan | 430/96 |
| 52-33536 | 3/1977 | Japan | 430/96 |

OTHER PUBLICATIONS

Patent Abstract of Japan, vol. 7, No. 241, p. 232, (Oct. 26, 1983).

Patent Abstract of Japan, vol. 7, No. 24, p. 232, (Oct. 26, 1983).

Patent Abstract of Japan, vol. 9, No. 109, p. 109, (May 14, 1985).

*Primary Examiner*—Roland E. Martin

*Attorney, Agent, or Firm*—Sughrue, Mion, Zinn, Macpeak & Seas

[57] ABSTRACT

An electrophotographic photoreceptor comprising a support having provided thereon at least one photoconductive layer containing at least an inorganic photoconductive substance and a binder resin is disclosed, wherein said binder resin contains (A) a resin having at least one kind of acidic group selected from the group consisting of $-PO_3H_2$, $-SO_3H$, and $-COOH$ at the terminal end of the main chain of the resin. The photoreceptor exhibits excellent electrostatic characteristics, image formation performance as well as printing suitability irrespective of change in environmental condition or the kind of sensitizing dyes to be used in combination with the photoreceptor.

12 Claims, No Drawings

ELECTROPHOTOGRAPHIC PHOTORECEPTOR WITH BINDER HAVING TERMINAL ACIDIC GROUP

FIELD OF THE INVENTION

This invention relates to an electrophotographic photoreceptor, and more particularly to an electrophotographic photoreceptor excellent in electrostatic characteristics, moisture resistance, and durability.

BACKGROUND OF THE INVENTION

An electrophotographic photoreceptor may have various structures in agreement with prescribed characteristics or electrophotographic processes applied.

Widely employed among them is a system in which a photoreceptor comprises a support having provided thereon at least one photoconductive layer and, if necessary, an insulating layer on the surface thereof. The photoreceptor composed of a support and at least one photoconductive layer is subjected to ordinary electrophotographic processing for image formation including charging, imagewise exposure, development and, if necessary, transfer.

Electrophotographic photoreceptors have also been used widely as offset printing plate precursor for direct printing plate making.

Binders to be used in the photoconductive layer should themselves have film-forming properties and the capability of dispersing photoconductive particles therein, and, when formulated into a photoconductive layer, binders should exhibit satisfactory adhesion to a support. They are also required to bear various electrostatic characteristics and image-forming properties, such that the photoconductive layer may exhibit excellent electrostatic capacity, small dark decay and large light decay, hardly undergo fatigue before exposure, and stably retain these characteristics against change of humidity at the time of image formation.

Binder resins which have been conventionally used include silicone resins (see JP-B-34-6670, the term "JP-B" as used herein means an "examined published Japanese patent application"), styrenebutadiene resins (see JP-B-35-1960), alkyd resins, maleic acid resins and polyamides (see JP-B-35-11219), vinyl acetate resins (see JP-B-41-2425), vinyl acetate copolymer resins (see JP-B-41-2426), acrylic resins (see JP-B-35-11216), acrylic ester copolymer resins (see JP-B-35-11219, JP-B-36-8510, and JP-B-41-13946), etc. However, electrophotographic photosensitive materials using these known resins suffer from any of numerous disadvantages, such as poor affinity for photoconductive particles (poor dispersion of a photoconductive coating composition); low charging properties of the photoconductive layer; poor quality of a reproduced image, particularly dot reproducibility or resolving powder; susceptibility of reproduced image quality to influences from the environment at the time of electrophotographic image formation, such as a high temperature and high humidity condition or a low temperature and low humidity condition; insufficient film strength or adhesion of the photoconductive layer, which causes, when used as an offset master plate, release of the photoconductive layer from the support during offset printing; failing to obtain a large number of prints; and the like.

In order to improve electrostatic characteristics of a photoconductive layer, various proposals have hitherto been made. For example, it has been proposed to incorporate into a photoconductive layer a compound containing an aromatic ring or furan ring containing a carboxyl group or nitro group either alone or in combination with a dicarboxylic acid anhydride as disclosed in JP-B-42-6878 and JP-B-45-3073. However, the thus improved photosensitive materials are still insufficient with regard to electrostatic characteristics, particularly in light decay characteristics. The insufficient sensitivity of these photosensitive materials has been compensated by incorporating a large quantity of a sensitizing dye into the photoconductive layer. However, photosensitive materials containing a large quantity of a sensitizing dye suffer from considerable deterioration of whiteness, which means reduced quality as a recording medium, sometimes causing deterioration of dark decay characteristics, resulting in the failure to obtain satisfactory reproduced image.

On the other hand, JP-A-60-10254 (the term "JP-A" as used herein means an "unexamined published Japanese patent application") suggests to control an average molecular weight of a resin to be used as a binder of the photoconductive layer. According to this suggestion, a combined use of an acrylic resin having an acid value of from 4 to 50 whose average molecular weight is distributed within two ranges, i.e., a range of from $1\times10^3$ to $1\times10^4$ and a range of from $1\times10^4$ and $2\times10^5$, would improve electrostatic characteristics, particularly reproducibility as a PPC photoreceptor on repeated use, moisture resistance and the like.

In the field of lithographic printing plate precursors, extensive studies have been conducted to provide binder resins for a photoconductive layer having electrostatic characteristics compatible with printing characteristics. Examples of binder resins so far reported to be effective for improving oildesensitivity of a photoconductive layer include a resin having a molecular weight of from $1.8\times10^4$ to $10\times10^4$ and a glass transition point of from 10° to 80° C. obtained by copolymerizing a (meth)acrylate monomer and a copolymerizable monomer in the presence of fumaric acid in combination with a copolymer of a (meth)acrylate monomer and a copolymerizable monomer other than fumaric acid as disclosed in JP-B-50-31011; a terpolymer containing a (meth)acrylic ester unit having a substituent having a carboxyl group at least 7 atoms distant from the ester linkage as disclosed in JP-A-53-54027; a tetra- or pentapolymer containing an acrylic acid unit and a hydroxyethyl (meth)acrylate unit as disclosed in JP-A-54-20735 and JP-A-57-202544; a terpolymer containing a (meth)acrylic ester unit having an alkyl group having from 6 to 12 carbon atoms as a substituent and a vinyl monomer containing a carboxyl group as disclosed in JP-A-58-68046; and the like.

Nevertheless, actual evaluations of the abovedescribed resins proposed for improving electrostatic characteristics, moisture resistance and durability revealed that none of these resins was satisfactory for practical use in charging properties, dark charge retention, photosensitivity, and surface smoothness of a photoconductive layer. The binder resins proposed for use in electrophotographic lithographic printing plate precursors were also proved by actual evaluations to give rise to problems relating to electrostatic characteristics and background staining of prints.

SUMMARY OF THE INVENTION

One object of this invention is to provide an electrophotographic photoreceptor having improved electrostatic characteristics, particularly dark charge retention and photosensitivity, and improved image reproducibility.

Another object of this invention is to provide an electrophotographic photoreceptor which can form a reproduced image of high quality irrespective of a variation of environmental conditions, such as a change to a low-temperature and low-humidity condition or a high-temperature and high-humidity condition.

A further object of this invention is to provide an electrophotographic photoreceptor which is hardly influenced by use of a sensitizing dye.

A still further object of this invention is to provide a lithographic printing plate precursor which exhibits excellent electrostatic characteristics, particularly dark charge retention and photosensitivity, reproduces an image faithful to an original, and provides a lithographic printing plate causing neither evenly spread background stains over the entire surface of prints nor dot-like stains of prints, and exhibiting excellent printing durability.

It has now been found that the above objects of this invention can be accomplished by an electrophotographic photoreceptor comprising a support having provided thereon at least one photoconductive layer containing at least inorganic photoconductive particles and a binder resin, wherein said binder resin contains (A) a resin containing at least one acidic group selected from the group consisting of $-PO_3H_2$, $-SO_3H$, and —COOH at the terminal end of the main chain thereof.

It has also been found that the printing durability of the above-described electrophotographic photoreceptor can further be improved by using a binder resin containing (1) the resin (A) as above defined with its weight average molecular weight ranging from $1\times10^3$ to $3\times10^4$ (hereinafter referred to as resin (A')) and (2) at least one resin selected from the group consisting of (B) a resin having a weight average molecular weight of from $1\times10^4$ to $5\times10^5$ but containing none of $-PO_3H_2$, $-SO_3H$, —COOH and not containing any basic groups, (C) a resin having a weight average molecular weight of from $1\times10^4$ to $5\times10^5$ and containing from 0.05 to 15% by weight of a copolymerization component having at least one functional group selected from a hydroxyl group and a basic group, and (D) a resin having a weight average molecular weight of from $1\times10^4$ to $5\times10^5$ and containing a copolymerization component having at least one acidi-c group selected from $-PO_3H_2$, $-SO_3H$, —COOH and

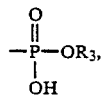

wherein $R_3$ represents a hydrocarbon group, said acid group having a higher pKa value than the acidic group contained in the resin (A).

DETAILED DESCRIPTION OF THE INVENTION

The resin (A) which can be used in the present invention as a binder contains at least one of the above described acidic groups (i.e., $-PO_3H_2$, $-SO_3H$, —COOH) at the terminal end of the main chain of the resin but not in the side chains linked to the main chain. The resin (A) preferably has a weight average molecular weight of from $1\times10^3$ to $3\times10^4$.

The acidic group in the resin (A) is present in resin (A) at a ratio of from 0.1 to 10 parts by weight per 100 parts by weight of the resin polymer.

The above-stated conventional binder resins containing an acidic group have been proposed chiefly for use as offset printing plate precursors and have a high molecular weight, for example, $5\times10^4$ or more, to ensure film strength retention for improving printing durability. Further, these copolymer resins are random copolymers, with an acidic group-containing a copolymerization component being present in the polymer main chain at random. To the contrary, the binder resin (A) according to the present invention contains the acidic group at the terminal of the main chain. It was confirmed that the acidic group moiety at the terminal is adsorbed onto stoichiometrical defects of the inorganic photoconductive substance to sufficiently cover the surface thereof, whereby electron traps of the photoconductive substance can be compensated for, humidity resistance can be improved, and the particles can be sufficiently dispersed without agglomeration. It is believed that a resin having a relatively low molecular weight has improved covering power for the surface of the photoconductive particles, while a resin having a relatively high molecular weight suppresses agglomeration of photoconductive particles, such agglomeration being a conspicuous phenomenon accompanying the conventional random copolymers having high molecular weight. Thus, the surface smoothness of the photoconductive layer can be improved by the use of the resin (A).

If a photoreceptor to be used as a lithographic printing plate precursor is prepared from a non-uniform dispersion of photoconductive particles in a binder resin containing agglomerates, the photoconductive layer would have a rough surface. As a result, non-image areas cannot be rendered uniformly hydrophilic by oil-desensitization treatment with an oil desensitizing solution. Therefore, upon printing the thus-prepared printing plate induces adhesion of a printing ink to the non-image areas. This adhesion leads to background stains on the non-image areas of prints.

In cases where the resin (A) has a low molecular weight, concerns relating to reduction of film strength exist. It was confirmed, however, that sufficient film strength can be assured for use as a CPC photoreceptor or an offset printing plate precursor for producing highly durable printing plate (having printing durability of thousands of prints) can be assured by sufficiently dispersing photoconductive particles in the binder so that the binder may sufficiently cover the surface of the particles through adsorption. It was further confirmed that the binder resin of the present invention proved highly photosensitive as compared with the resins having an acidic group in side chains linked to the main chain thereof.

Resin (A) having a molecular weight less than $1\times10^3$ tends to have reduced film-forming properties, failing to keep sufficient film strength. On the other hand, resin (A) having a molecular weight more than $3\times10^4$ tends to have deteriorated electrophotographic characteristics, particularly initial potential and dark charge retention.

When the acidic group content in the resin (A) is less than 0.1% by weight, the initial potential attained tends to become low, making it hard to obtain a sufficient image density. If the content exceeds 10% by weight, there is a tendency toward reduction of dispersing properties which would in turn lead to reduction of film smoothness, reduction of humidity resistance of electrophotographic characteristics, and increase of background stains on use as an offset master plate.

The resin (A) preferably has a glass transition point between −10° and 100° C., more preferably between −5° and 80° C.

As long as the above-described physical properties are achieved, any of conventionally known resins can be used as the resin (A). Examples of usable resins include polyester resins, modified epoxy resins, silicone resins, olefin copolymer resins, polycarbonate resins, vinyl alkanoate resins (vinyl ester resins of aliphatic acids), allyl alkanoate resins (allyl ester resins of aliphatic acids), modified polyamide resins, phenolic resins, fatty acid-modified alkyd resins, acrylic resins, and so on.

More specifically, the resin (A) includes (meth)acrylate homo- or copolymers containing 30% or more by weight of a monomer represented by formula (I) shown below.

Formula (I) is represented by

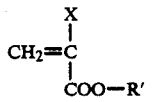

(I)

wherein X represents a hydrogen atom, a halogen atom (e.g., chlorine and bromine), a cyano group or an alkyl group having from 1 to 4 carbon atoms; and R′ represents a substituted or unsubstituted alkyl group having from 1 to 18 carbon atoms (e.g., methyl, ethyl, propyl, butyl, pentyl, hexyl, octyl, decyl, dodecyl, tridecyl, tetradecyl, 2-methoxyethyl, and 2-ethoxyethyl), a substituted or unsubstituted alkenyl group having from 2 to 18 carbon atoms (e.g., vinyl, allyl, isopropenyl, butenyl, hexenyl, heptenyl, and octenyl), a substituted or unsubstituted aralkyl group having from 7 to 12 carbon atoms (e.g., benzyl, phenethyl, methoxybenzyl, ethoxybenzyl, and methylbenzyl), a substituted or unsubstituted cycloalkyl group having from 5 to 8 carbon atoms (e.g., cyclopentyl, cyclohexyl, and cycloheptyl), or a substituted or unsubstituted aryl group (e.g., phenyl, tolyl, xylyl, mesityl, naphthyl, methoxyphenyl, ethoxyphenyl, chlorophenyl, and dichlorophenyl).

In the copolymers comprising the monomer of formula (I), copolymerizable monomers include α-olefins, vinyl alkanoates, allyl alkanoates, acrylonitrile, methacrylonitrile, vinyl ethers, acrylamides, methacrylamides, styrenes, and heterocyclic vinyl compounds (e.g., vinylpyrrolidone, vinylpyridine, vinylimidazole, vinylthiophene, vinylimidazoline, vinylpyrazole, vinyldioxane, vinylquinoline, vinylthioazole, vinyl-oxazine, etc.). Among them, vinyl acetate, allyl acetate, acrylonitrile, methacrylonitrile, and styrenes are preferred from the standpoint of improvement on film strength.

The resin (A) can be synthesized in such a manner that an acidic group selected from $—PO_3H_2$, $—SO_3H$ and —COOH is bonded to the terminal of a main chain of a polymer comprising the above-described monomer or monomers. More specifically, the resin (A) can be prepared by a method of using a polymerization initiator containing the acidic group or a precursor thereof; a method of using a chain transfer agent containing the acidic group or a precursor thereof; a combination of these methods; a method of utilizing termination reaction in anionic polymerization to introduce the above-described functional group; or the like technique. For the details, reference can be made to the techniques disclosed in P. Dreyfuss and R.P. Quirk, *Encycl. Polym. Sci. Eng.*, Vol. 7, 551 (1987), V. Percec, *Appl. Polymer. Sci.*, Vol. 285, 95 (1985), P.F. Rempp. and E. Franta, *Adv. Polym. Sci.*, Vol. 58, 1 (1984), Y. Yamashita, *J. Appl. Polym. Sci. Appl. Polym. Symp.*, Vol. 36, 193 (1981), R. Asami and M. Takaki, *Makromol. Chem. Suppl.*, Vol. 12, 163 (1985), etc.

In a preferred embodiment of the present invention, printing durability of the electrophotographic photoreceptor can further be improved by using a resin (A′) which is implicit in the resin (A) but whose weight average molecular weight ranged from $1\times10^3$ to $1.5\times10^4$ in combination with at least one of resins (B), (C), and (D) each having a high weight average molecular weight of from $1\times10^4$ to $5\times10^5$.

The resins (B) to (D) serve to ensure mechanical strength of the photosensitive layer formed by using the resin (A). In particular, when the electrophotographic photoreceptor obtained by using the resin (A′) in combination with the high-molecular resin (B), (C) or (D) is applied to a lithographic printing plate precursor, the inorganic photoconductive particles, e.g., zinc oxide, can be sufficiently dispersed in the binder resin to form a photoconductive layer with improved smoothness so that the non-image area can be sufficiently and uniformly rendered hydrophilic on oil-desensitization treatment. Offset printing plates produced from these printing plate precursors cause no background stains even after production of a number of prints reaching 10,000.

That is, in this preferred embodiment, it is ensured that the above-mentioned adsorption and covering effects of the binder resin are exerted on inorganic photoconductive particles, and the film strength retention of the photoconductive layer can also be ensured.

The combined use of the resin (A′) having a weight average molecular weight of from $1\times10^3$ to $3\times10^4$ and the high-molecular resin (B), (C) and/or (D) will be explained in detail as particular combinations.

I. Combination of Resin (A′) and Resin (B):

The resin (A′) to be combined with the high-molecular resin (B) preferably contains from 0.05 to 20% by weight, more preferably from 0.5 to 10% by weight, of the acidic group. The resin (A′) has a weight average molecular weight of from $1\times10^3$ to $1.5\times10^4$, preferably from $3\times10^3$ to $1\times10^4$.

The resin (B) is a resin containing neither an acidic group nor a basic group in the main chain or thermals thereof. The resin (B) has a weight average molecular weight of from $1\times10^4$ to $5\times10^5$, more preferably from $2\times10^4$ to $3\times10^5$, and a glass transition point of from 0° to 120° C., more preferably from 10 to 80° C.

Any binder resins commonly employed for electrophotographic use can be used either alone or in combination as the resin (B). Such resins are described, e.g., in Harutomo Miyahara and Hidehiko Takei, *Imaqinq*, Vol. 1978, No. 8, 9 to 12 and Takaharu Kurita and Jiro Ishiwatari, *Kobunshi*, Vol. 17, 178 to 184 (1968). Specific examples include olefin polymers or copolymers, vinyl chloride copolymers, vinylidene chloride copolymers, vinyl alkanoate polymers or copolymers, allyl alkanoate polymers or copolymers, styrene (or its derivative) polymers or copolymers, butadiene-styrene copolymers, isoprene-styrene copolymers, butadiene-unsaturated carboxylic acid ester copolymers, acrylonitrile copolymers, methacrylonitrile copolymers, alkyl vinyl ether copolymers, acrylate polymers or copolymers, methacrylate polymers or copolymers, styrene-acrylate copolymers, styrenemethacrylate copolymers, itaconic diester polymers or copolymers, maleic anhydride copolymers, acrylamide copolymers, methacrylamide copolymers, hydroxylmodified silicone resins, polycarbonate resins, ketone resins, amide resins, hydroxyl- and carboxyl-modified polyester resins, butyral resins, polyvinyl acetal resins, cyclized rubber-methacrylate copolymers, copolymers containing a heterocyclic ring containing no nitrogen atom (the heterocyclic ring thereof includes furan, tetrahydrofuran, thiophene, dioxane, dioxolane, lactone, benzofuran, benzothiophene, and 1,3-dioxetane rings), and epoxy resins.

More specifically, the resin (B) includes (meth)acrylate homo- or copolymers comprising at least 30% by weight of a (meth)acrylic ester of formula (I) above. Specific examples of preferred monomers of formula (I) are the same as those enumerated above.

Comonomers copolymerizable with the (meth)acrylic ester of formula (I) include α-olefins, vinyl alkanoates, allyl alkanoates, acrylonitrile, methacrylonitrile, vinyl ethers, acrylamides, methacrylamides, styrenes, and heterocyclic vinyl compounds (e.g., 5- to 7-membered heterocyclic compounds containing 1 to 3 nonmetallic hetero atoms other than nitrogen (e.g., oxygen or sulfur), e.g., vinylthiophene, vinyl-dioxane and vinylfuran). Of these, preferred are vinyl or allyl alkanoates having from 1 to 3 carbon atoms in the alkyl moiety thereof, acrylonitrile, methacrylonitrile, and styrene or derivatives thereof (e.g., vinyltoluene, butylstyrene, methoxystyrene, chlorostyrene, dichlorostyrene, bromostyrene, and ethoxystyrene).

Basic groups which should not be present in the resin (B) include a substituted or unsubstituted amino group and a nitrogen-containing heterocyclic group.

II. Combination of Resin (A') and Resin (C):

The resin (A') to be combined with the resin (C) preferably contains from 0.05 to 20% by weight, more preferably from 0.5 to 10% by weight, of the acidic group. The weight average molecular weight of the resin (A') ranges from $1\times10^3$ to $1.5\times10^4$, preferably from $3\times10^3$ to $1\times10^4$.

The resin (C) is a high-molecular polymer containing from 0.05 to 15% by weight, preferably from 0.5 to 10% by weight, of a copolymerization component containing a hydroxyl group and/or a basic group. The resin (C) has a weight average molecular weight of from $1\times10^4$ to $5\times10^5$, preferably from $3\times10^4$ to $1\times10^5$, and preferably has a glass transition point of from 0° to 120° C., more preferably from 10° to 80° C.

The hydroxyl- or basic group-containing component in the resin (C) is considered to exert a weak mutual action upon both interfaces of photoconductive particles and the resin (A') to thereby stabilize the dispersion of the photoconductive particles and, at the same time, to improve film strength after film formation. If the content of this component in the resin (C) exceeds 15% by weight, the resin is influenced by water, resulting in reduction of moisture resistance of the photoconductive layer.

Any of the known resins as described for the resin (A) can be applied as the resin (C) as far as the above-described physical properties are met. More specifically, the resin (C) includes (meth)acrylate copolymers containing at least 30% by weight of a copolymerization component represented by formula (I). Specific examples of preferred monomers of formula (I) are the same as those enumerated above.

The copolymerization component containing a hydroxyl group and/or a basic group in the resin (C) may be any of vinyl compounds having a hydroxyl group and/or a basic group which are copolymerizable with the monomer of formula (I).

The basic group present in the copolymerization component includes an amino group represented by formula (II) shown below and a nitrogen-containing heterocyclic group.

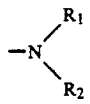

(II)

wherein $R_1$ and $R_2$, which may be the same or different, each represents a hydrogen atom, a substituted or unsubstituted alkyl group (e.g., methyl, ethyl, propyl, butyl, hexyl, octyl, decyl, dodecyl, tetradecyl, octadecyl, 2-chloroethyl, 2-bromoethyl, 2-hydroxyethyl, 2-cyanoethyl, 2-methoxyethyl, and 3-ethoxypropyl), a substituted or unsubstituted alkenyl group (e.g., allyl, isopropenyl, and 4-butynyl), a substituted or unsubstituted aralkyl group (e.g., a benzyl, phenethyl, chlorobenzyl, methylbenzyl, methoxybenzyl, and hydroxybenzyl), an alicyclic group (e.g,, cyclopentyl and cyclohexyl), a substituted or unsubstituted aryl group (e.g., phenyl, tolyl, xylyl, mesityl, butylphenyl, methoxyphenyl, and chlorophenyl), etc.; or $R_1$ and $R_2$ are connected to each other via a hydrocarbon group which may contain a hetero atom.

The nitrogen-containing heterocyclic ring includes substituted or unsubstituted 5- to 7-membered rings containing 1 to 3 nitrogen atoms, which may be condensed with a benzene ring, a naphthalene ring, etc. Specific examples of these heterocyclic rings are pyrrole, imidazole, pyrazole, pyridine, piperazine, pyrimidine, pyridazine, indolizine, indole, 2H-pyrrole, 3H-indole, indazole, purine, morpholine, isoquinoline, phthalazine, naphthyridine, quinoxazine, acridine, phenanthridine, phenazine, pyrrolidine, pyrroline, imidazolidine, imidazoline, pyrazolidine, pyrazoline, piperidine, piperazine, quinacridone, indoline, 3,3-dimethylindolenine, 3,3-dimethylnaphthoindolenine, thiazole, benzothiazole, naphthothiazole, oxazole, benzoxazole, naphthoxazole, selenazole, benzoselenazole, naphthoselenazole, oxazoline, isoxazole, benzoxazole, morpholine, pyrrolidone, triazole, benzotriazole, and triazine rings.

The monomer containing a hydroxyl group and/or a basic group can be prepared by incorporating a hydroxyl group and/or the basic group into a substituent of an ester derivative or amide derivative derived from a vinyl-containing carboxylic acid or sulfonic acid as described in Kobunshi Gakkai (ed.), *Kobunshi Data Handbook* (*Kisohen*), Baihukan (1986). Specific examples of such monomer include 2-hydroxyethyl methacrylate, 3-hydroxypropyl methacrylate, 3-hydroxy-2-chloromethacrylate, 4-hydroxybutyl methacrylate, 6-hydroxyhexyl methacrylate, 10-hydroxydecyl methacrylate, N-(2-hydroxyethyl)acrylamide, N-(3-hydroxypropyl)methacrylamide, N-(α,α-dihydroxymethyl)ethylmethacrylamide, N (4-hydroxybutyl)methacrylamide, N,N-dimethylaminoethyl methacrylate, 2-(N,N-diethylaminoethyl) methacrylate, 3-(N,N-dimethylpropyl) methacrylate, 2-(N,N-dimethylethyl)methacrylamide, hydroxystyrene, hydroxymethylstyrene, N,N-dimethylaminomethylstyrene, N,N-dimethylaminoethylstyrene, N-butyl-N-methylaminomethylstyrene, N-(hydroxyphenyl)methacrylamide, and so on.

Specific examples of the vinyl compound having a nitrogen-containing heterocyclic ring are described, e.g., in Kobunshi Gakkai (ed.), *Kobunshi Data Handbook* (*Kisohen*), 175 to 181, Baihukan (1986), D.A. Tamalia, *Functional Monomers*, Vol. 2, Chap. 1 "Reactive Heterocyclic Monomers", Marcel Derrer Inc., N.Y. (1974), and L.S. LusRin, *Functional Monomers*, Vol. 12, Chap. 3 "Basic Monomers", Marcel Derrer Inc., N.Y. (1974).

In addition to the above-described monomer of formula (I) and the hydroxyl- and/or basic groupcontaining monomer, the resin (C) may further comprise other copolymerization components. Specific examples of such copolymerization components are the same as those enumerated as the other copolymerizable components in the resin (A).

III. Combination of Resin (A') and Resin (D):

The resin (A') to be combined with the resin (D) has a weight average molecular weight of from $1\times10^3$ to $1.5\times10^4$, preferably from $3\times10^3$ to $1\times10^4$, and preferably contains from 0.1 to 20% by weight of the acidic group.

The resin (D) is a high-molecular polymer containing at least one kind of acidic group selected from $-PO_3H_2$, $-SO_3H$, $-COOH$, and

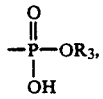

wherein $R_3$ represents a hydrocarbon group, in the side chain of the copolymerization component thereof, the acidic group having a higher pKa value than that of the acidic group in the resin (A').

The resin (D) preferably has a weight average molecular weight of from $3\times10^4$ to $2\times10^5$ and a glass transition point of from 0° to 120° C., more preferably from 0° to 100° C., most preferably from 10° to 80° C.

The content of the acidic group in the side chain of the resin (D) preferably ranges from 0.05 to 5% by weight based on the resin (D). A preferred combination of the acidic groups in the resin (A') and the resin (D) are shown below.

| Resin (A') | Resin (D) |
|---|---|
| $-SO_3H$ and/or $-PO_3H_2$ | $-COOH$ |
| $-SO_3H$, $-PO_3H_2$ and/or $-COOH$ | $-\overset{\overset{O}{\|}}{\underset{\underset{OH}{\|}}{P}}-OR_3$ |

In the acidic group

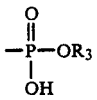

for the resin (D), $R_3$ specifically represents a substituted or unsubstituted alkyl group having from 1 to 12 carbon atoms (e.g., methyl, ethyl, propyl, butyl, hexyl, octyl, decyl, dodecyl, 2-chloroethyl, 2-methoxyethyl, 2-ethoxyethyl, and 3-methoxypropyl), a substituted or unsubstituted aralkyl group having from 7 to 12 carbon atoms (e.g., benzyl, phenethyl, chlorobenzyl, methoxybenzyl, and methylbenzyl), a substituted or unsubstituted alicyclic group having from 5 to 8 carbon atoms (e.g., cyclopentyl and cyclohexyl) or a substituted or unsubstituted aryl group (e.g., phenyl, tolyl, xylyl, mesityl, naphthyl, chlorophenyl, and methoxyphenyl).

When the acidic group content in the resin (D) exceeds 5% by weight, there is a tendency that the resin (D) is adsorbed onto photoconductive particles to impair dispersion of the particles, causing agglomeration or precipitation of the particles. As a result, the dispersion loses its film-forming properties or, if any film could be formed, the resulting photoconductive layer would have considerably deteriorated electrostatic characteristics or much rough surface with deteriorated resistance to mechanical abrasion.

The resin (D) functions to cover photoconductive particles only very slightly through a much weaker action upon photoconductive particles than the resin (A'). Therefore, the resin (D) serves to ensure mechanical strength of the photoconductive layer without adversely affecting the functions of the resin (A').

Any of the conventional known resins as described with respect to the resin (A) can be used as the resin (D) as long as the above-described physical properties are possessed. More specifically, the resin (D) includes (meth)acrylate copolymers containing at least 30% by weight of a copolymerization component represented by formula (I). Specific examples of the monomer of formula (I) are the same as enumerated above.

The copolymerization component containing the acidic group in the resin (D) may be any of acidic group-containing vinyl compounds copolymerizable with the monomer of formula (I). Examples of such vinyl compounds are described, e.g., in Kobunshi Gakkai (ed.), *Kobunshi Data Handbook* (*Kisohen*), Baihukan (1986). Specific examples of these vinyl compounds are acrylic acid, α- and/or β-substituted acrylic acids (e.g., α-acetoxy, α-acetoxymethyl, α-(2-aminomethyl), α-chloro, α-bromo, α-fluoro, α-tributylsilyl, α-cyano, β-chloro, β-bromo, α-chloro-β-methoxy, and α,β-dichloro compounds), methacrylic acid, itaconic acid, itaconic half esters, itaconic half amides, crotonic acid, 2-alkenylcarboxylic acids (e.g., 2-pentenoic acid, 2-methyl-2-hexenoic acid, 2-octenoic acid, 4-methyl-2-hxenoic acid, and 4-ethyl-2-octenoic acid), maleic acid, maleic half esters, maleic half amides, vinylbenzenecarboxylic acid, vinylbenzenesulfonic acid, vinylsulfonic acid, vinylphosphonic acid, dicarboxylic acid vinyl or allyl half esters, and ester or amide derivatives of these carboxylic acids or sulfonic acids containing the acidic group in the substituent thereof.

The resin (D) may further comprise other copolymerizable monomers in addition to the monomer of formula (I) and the acidic group-containing monomer.

Specific examples of the copolymerizable monomer are the same as those enumerated above with respect to the resin (A).

The resin (A) and the combination of the resin (A') and the resin (B), (C) and/or the resin (D) may further contain other known resins in a proportion of up to 30% by weight of the total binder resin. The other resins to be combined include alkyd resins, polybutyral resins, polyolefins, ethylene-vinyl acetate copolymers, styrene resins, styrene-butadiene resins, acrylate-butadiene resins, and vinyl alkanoate resins.

If the content of these other resins exceeds 30% by weight of the total binder resin, the effects of the present invention, especially improvement on electrostatic characteristics, cannot be manifested.

The ratio of the resin (A') and at least one of the resins (B), (C) and (D) varies depending on the kind, particle size and surface conditions of the inorganic photoconductive substance to be dispersed therein. In general, the weight ratio of the resin (A') to at least one of the resins (B), (C) and (D) ranges from 5 to 80 : 95 to 20, preferably from 15 to 60 : 85 to 40. It is preferable that the weight average molecular weight ratio of the resins (B), (C) and/or (D) to the resin (A') is 1.2 or more, more preferably 2.0 or more.

The inorganic photoconductive substance which can be used in the present invention includes zinc oxide, titanium oxide, zinc sulfide, cadmium sulfide, cadmium carbonate, zinc selenide, cadmium selenide, tellurium selenide, lead sulfide, and the like.

The binder resin according to the present invention is used in an amount of from 10 to 100 parts by weight, preferably from 15 to 50 parts by weight, per 100 parts by weight of the inorganic photoconductive substance.

If desired, the photoconductive layer according to the present invention may contain various spectral sensitizers. Examples of the spectral sensitizers are carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), phthalocyanine dyes (inclusive of metallized dyes), and the like. Reference can be made to H. Miyamoto and H. Takei, *Imaging,* Vol. 1973, No. 8, p12, C.J. Young, et al., *RCA Review,* Vol. 15, 469 (1954), Kohei Kiyota, et al., *Denditsushin Gakkai Ronbunshi, J* 63-C, No. 2, 97 (1980), Yuji Harasaki, et at., *Kogyo Kagaku Zasshi,* Vol. 66, 78 and 188 (1963), and Tadaaki Tani, Nihon *Shashin Gakkaishi,* Vol. 35, 208 (1972).

Specific examples of the carbonium dyes, triphenylmethane dyes, xanthene dyes, and phthalein dyes are described in JP-B-51-452, JP-A-50-90334, 50-114227, 53-3930, and 53-82353, U.S. Pat. Nos. 3,052,540 and 4,054,450, and JP-A-57-16456.

The polymethine dyes, such as oxonol dyes, merocyanine dyes, cyanine dyes, and rhodacyanine dyes, include those described in F.M. Harmmer, *The Cyanine Dyes and Related Compounds.* Specific examples are described in U.S. Pat. Nos. 3,047,384, 3,110,591, 3,121,008, 3,125,447, 3,128,179, 3,132,942, and 3,622,317, British Patent Nos. 1,226,892, 1,309,274, and 1,405,898, and JP-B-48-7814 and 55-18892.

In addition, polymethine dyes capable of spectrally sensitizing in the longer wavelength region of 700 nm or more, i.e., from near the infrared region to the infrared region, include those described in JP-A-47-840 and 47-44180, JP-B-51-41061, JP-A-49-5034, 49-45122, 57-46245, 56-35141, 57-157254, 61-26044, and 61-27551, U.S. Pat. Nos. 3,619,154 and 4,175,956, and *Research Disclosure,* 216, 117–118 (1982).

The photoreceptor of the present invention is particularly excellent in that the performance properties are not liable to variation even when combined with various kinds of sensitizing dyes.

If desired, the photoconductive layer may further contain various additives commonly employed in the electrophotographic photoconductive layer, such as chemical sensitizers. Examples of the additives include electron-accepting compounds (e.g., halogen, benzoquinone, chloranil, acid anhydrides, and organic carboxylic acids) described in the above-cited *Imaging,* Vol. 1973, No. 8, p12; and polyarylalkane compounds, hindered phenol compounds, and p-phenylenediamine compounds described in Hiroshi Komon, et al., *Saikin-no Kododen Zairyo to Kankotai no Kaihatsu Jitsuyoka,* Chaps. 4 to 6, Nippon Kagaku Joho (1986).

The amount of these additives is not particularly critical and usually ranges from 0.0001 to 2.0 parts by weight per 100 parts by weight of the photoconductive substance.

The photoconductive layer of the photoreceptor suitably has a thickness of from 1 to 100 μm, particularly from 10 to 50 μm.

In cases where the photoconductive layer functions as a charge generating layer in a laminated photoreceptor composed of a charge generating layer and a charge transport layer, the thickness of the charge generating layer suitably ranges from 0.01 to 1 μm, particularly from 0.05 to 0.5 μm.

If desired, an insulating layer can be provided on the photoreceptor of the present invention. When the insulating layer is made to serve for the main purposes of protection and improvement of durability and dark decay characteristics, its thickness is relatively small. When the insulating layer is formed to provide a photoreceptor suitable for application to special electrophotographic processings, its thickness is relatively large, usually ranging from 5 to 70 μm, particularly from 10 to 50 μm.

Charge transport materials in the above-described laminated photoreceptor include polyvinylcarbazole, oxazole dyes, pyrazoline dyes, and triphenylmethane dyes. The thickness of the charge transport layer ranges from 5 to 40 μm, preferably from 10 to 30 μm.

Resins to be used in the insulating layer or charge transport layer typically include thermoplastic and thermosetting resins, e.g., polystyrene resins, polyester resins, cellulose resins, polyether resins, vinyl chloride resins, vinyl acetate resins, vinyl chloride-vinyl acetate copolymer resins, polyacrylate resins, polyolefin resins, urethane resins, epoxy resins, melamine resins, and silicone resins.

The photoconductive layer according to the present invention can be provided on any known support. In general, a support for an electrophotographic photosensitive layer is preferably electrically conductive. Any of conventionally employed conductive supports may be utilized in this invention. Examples of usable conductive supports include a base, e.g., a metal sheet, paper, a plastic sheet, etc., having been rendered electrically conductive by, for example, impregnating with a low resistant substance; the above-described base with the back side thereof (opposite to the photosensitive layer side) being rendered conductive and having further coated thereon at least one layer for the purpose of prevention of curling; the aforesaid supports having provided thereon a water-resistant adhesive layer; the aforesaid supports having provided thereon at least one precoat layer; and paper laminated with a plastic film on which aluminum, etc. is deposited.

Specific examples of conductive supports and materials for imparting conductivity are described in S. Sakamoto, *Denshishashin*, Vol. 54, No. 1, 2-11 (1975), H. Moriga, *Nyumon Tokushushi no Kagaku*, Kobunshi Kankokai (1975), and M.F. Hoover, *J. Macromol. Sci. Chem.*, A-4(6), 1327-1417 (1970).

The present invention will now be illustrated in greater detail by way of examples and comparative examples, but it should be understood that the present invention is not deemed to be limited thereto.

EXAMPLE 1 AND COMPARATIVE EXAMPLES A AND B

Synthesis of Resin (A-1):

A solution of 95 g of ethyl acrylate in 200 g of toluene was heated at 90° C. in a nitrogen stream, and 5 g of 4,4'-azobis(4-cyanovaleric acid) (hereinafter abbreviated as ABCV) was added thereto to effect polymerization for 10 hours. The resulting resin [designated as (A-1)]had a weight average molecular weight of 8,300 and a glass transition point of 46° C.

Synthesis of Resin (A-2):

A solution of 95 g of ethyl methacrylate and 5 g of acrylic acid in 200 g of toluene was heated at 90° C. in a nitrogen stream, and 6 g of 2,2'-azobis(2,4dimethylvaleronitrile) was added thereto to effect copolymerization for 10 hours. The resulting resin (A-2) had a weight average molecular weight of 7,800 and a glass transition point of 45° C.

Synthesis of Resin (A-3):

A solution of 100 g of ethyl methacrylate in 200 g of toluene was heated at 90° C in a nitrogen stream, and 6 g of 2,2'-azobis(2,4-dimethylvaleronitrile) was added thereto to effect reaction for 10 hours. The resulting resin (A-3) had a weight average molecular weight of 7,500 and a glass transition point of 45° C.

Preparation of Photoreceptor:

A mixture consisting of 50 g (solid basis) of (A-1), 200 g of zinc oxide, 0.05 g of Rose Bengale, and 300 g of toluene was dispersed in a ball mill for 2 hours. The resulting photosensitive composition was coated on paper having, been rendered conductive with a wire bar to a dry coating amount of 22 g/m$^2$, followed by drying at 110° C. for 1 minute. The coating was allowed to stand in a dark place at 20° C. and 65% RH (relative humidity) for 24 hours to prepare an electrophotographic photoreceptor (designated as Sample 1).

For comparison, Sample A was prepared in the same manner as for Sample 1, except for replacing (A-1) with 40 g (solid basis) of (A-2).

For further comparison, Sample B was prepared in the same manner as for Sample 1, except for replacing (A-1) with 40 g (solid basis) of (A-3).

Each of Samples 1, A, and B was evaluated for film properties in terms of surface smoothness; electrostatic characteristics; image forming performance; and stability of image forming performance against variation of environmetal conditions. Further, an offset master plate was produced from each of the samples, and the oil-desensitivity of the photoconductive layer in terms of contact angle with water after oil-desensitization and printing performances in terms of background stain resistance and printing durability were evaluated in accordance with the following test methods.

(1) -Smoothness of Photoconductive Layer:

The smoothness (sec/cc) was measured by means of a Beck's smoothness tester manufactured by Kumagaya Riko K.K. under an air volume condition of 1 cc.

(2) Electrostatic Characteristics:

The sample was charged by corona discharge to a voltage of 6 kV for 20 seconds in a dark room at 20° C. and 65% RH using a paper analyzer ("Paper Analyzer SP-428" manufactured by Kawaguchi Denki K.K.). After the elapse of 10 seconds from the end of the corona discharge, the surface potential $V_{10}$ was measured. The standing of the sample in dark was further continued for an additional 60 seconds, and the potential $V_{70}$ was measured. The dark decay retention (DRR; %), i.e., percent retention of potential after dark decay for seconds, was calculated from equation:

$$DRR\ (\%) = (V_{70}/V_{10}) \times 100$$

Separately, the sample was charged to −400 V by corona discharge and then exposed to visible light at an illumination of 2.0 lux, and the time required for decay of the surface potential $V_{10}$ to one-tenth was measured to obtain an exposure $E_{1/10}$ (lux.sec).

(3) Image Forming Performance:

Each of the samples was allowed to stand for one day at 20° C. and 65% RH (Condition I) or at 30° C. and 80% RH (Condition II) and then electrophotographically processed by means of an automatic plate making machine ("ELP-404V" produced by Fuji Photo Film Co., Ltd.) and a developer ("ELP-T" produced by Fuji Photo Film Co., Ltd.). The printing plate precursor was then etched with an oil-desensitizing solution ("ELP-E" produced by Fuji Photo Film Co., Ltd.) by means of an etching processer to produce a lithographic printing plate. The image reproduced on the resulting printing plate was visually evaluated for fog and image quality.

(4) Contact Angle With Water:

The sample was passed once through an etching processor using an oil-desensitizing solution (ELP-E) to render the .surface of the photoconductive layer oil-desensitive. On the thus oil-desensitized surface was placed a drop of 2 μl of distilled water, and the contact angle formed between the suface and water was measured by a goniometer.

(5) Stain Resistance:

The sample was processed by means of an automatic plate making machine (ELP-404V) using a toner (ELP-T) to form a toner image, and the surface of the photoconductive layer was subjected to oil-desensitization under the same conditions as in (3) above. The resulting lithographic printing plate was mounted on a printing machine ("Hamada Star-800SX" manufactured by Hamada Star Co., Ltd.), and printing was carried out on fine paper to obtain 500 prints. The above-described conditions for plate making and printing were designated as Condition I. All the resulting prints were visually evaluated for background stains.

The same evaluation was repeated except for adopting severer conditions, that is, the oil-desensitizing solution was 5-fold diluted and the dampening water was 2-fold diluted. These conditions for plate making and printing were designated as Condition II.

(6) Printing Durability:

The sample was electrophotographically processed to produce a printing plate, and printing was carried out under the same conditions of Condition I of (5) above.

The printing durability of the printing plate was evaluated in terms of the number of prints obtained until background stains on non-image areas appeared or the quality of image areas was deteriorated. The larger the number of the prints, the higher the printing durability.

The results obtained are shown in Table 1 below.

TABLE 1

| | Sample 1 | Sample A | Sample B |
|---|---|---|---|
| Surface Smoothness (sec/cc) | 85 | 80 | 90 |
| $V_{10}$ (−V) | 500 | 500 | 300 |
| DRR (%) | 93 | 85 | 40 |
| $E_{1/10}$ (lux.sec) | 3.5 | 8.5 | 4.0 |
| Image Forming Performance: | | | |
| Condition I | good | good | poor ($D_{max}$ was unmeasurable*) |
| Condition II | good | good | very poor ($D_{max}$ was unmeasurable*) |
| Contact Angle With Water (°) | 12 | 13 | 15 |
| Background Stain Resistance: | | | |
| Condition I | excellent | excellent | excellent |
| Condition II | good | good | good |
| Printing Durability | 3,500 | 3,000 | 500 (no ink was received) |

Note:
*The maximum density ($D_{max}$) of the solid toner image area was measured by means of a Macbeth reflective densitometer.

As can be seen from Table 1, Sample 1 according to the present invention exhibited satisfactory surface smoothness and electrophotographic characteristics. When it was used as an offset master plate precursor, the reproduced image was clear and free from background stains on the non-image area. The superiority of the photoreceptor of the invention seems to be attributed to sufficient adsorption of the binder resin onto the photoconductive substance and sufficient covering over the surface of the photoconductive particles with the binder resin. For the same reason, when the photoreceptor is applied as an offset master plate precursor, oil-desensitization with an oil-desensitizing solution sufficiently proceeds to render non-image areas sufficiently hydrophilic, as proved by such a small contact angle of 15° or less with water. On practical printing, no background stains were observed in the prints.

To the contrary, Sample A exhibits reduced photosensitivity as compared with Sample 1. Therefore, should an original be a thin line image or a low density image or contain stains on the white background thereof, the reproduced image has poor quality.

Sample B, wherein a resin containing no acidic group is used as a binder, exhibited satisfactory smoothness of the photoconductive layer and showed sufficient progress in oil-desensitization. However, the photoconductive layer was seriously inferior in electrostatic characteristics, particularly initial potential and dark charge retention, and the reproduced image had a significantly reduced density. When the offset printing plate produced therefrom is used for printing, although no background stains were formed owing to the sufficient hydrophilic properties of the non-image area, the density of the image area was low with a small deposit of toner. As a result, the receptivity of the toner image area to a printing ink was rapidly reduced during printing, and the image area came to the shortage of the ink to cause cut-off of a line image or disappearance of a solid image. This is believed to be because a low-molecular weight resin containing no acidic group exerts an activity so as to disperse the photoconductive particles but its adsorption onto the photoconductive particles is not sufficient to satisfy the electrostatic characteristic requirements.

From all these considerations, an electrophotographic photoreceptor satisfying both electrostatic characteristics and printing suitability can be obtained by using the resin according to the present invention.

EXAMPLE 2

A solution of 95 g of ethyl methacrylate and 5 g of thioglycolic acid in 200 g of toluene was heated at 75° C. in a nitrogen stream, and 1.0 g of azobisisobutyronitrile was added to the solution to effect reaction for 8 hours. The resulting resin (A-4) had a weight average molecular weight of 7,800 and a glass transition point of 46° C.

A photoreceptor was prepared in the same manner as for Sample 1, except for replacing (A-1) with 40 g (solid basis) of (A-4). This photoreceptor was designated as Sample 2. Various performance properties of Sample 2 were evaluated in the same manner as in Example 1. As a result, the photoconductive layer had a smoothness of 80 sec/cc, $V_{10}$ of −540 V, DRR of 93%, and $E_{1/10}$ of 3.6 lux.sec, and reproduced an image of satisfactory quality even after preservation at 38° C. and 80% RH.

Thus, the photoreceptor of the present invention proves excellent not only in charging properties, dark charge retention, and photosensitivity but also in image reproducibility to provide a clear reproduced image involving neither background fog nor cut-off of a thin line image even when exposed to severe environmental conditions of high temperature and high humidity (30° C., 80% RH).

EXAMPLE 3 AND COMPARATIVE EXAMPLE 3

Synthesis of Resin (A-5):

A solution of 99 g of ethyl methacrylate in 200 g of toluene was heated at 60° C. under a nitrogen stream, and 0.3 g of ABCV was added thereto to effect reaction for 20 hours. The resulting resin (A-5) had a weight average molecular weight of 82,000 and a glass transition point of 49° C.

Synthesis of Resin (A-6):

A solution of 99 g of ethyl methacrylate and 1 g of acrylic acid in 200 g of toluene was heated to 60° C. in a nitrogen stream, and 0.3 g of azobisisobutyronitrile was added thereto to effect reaction for 20 hours. The resulting copolymer resin (A-6) had a weight average molecular weight of 78,000 and a glass transition point of 49° C.

An electrophotographic photoreceptor was prepared in the same manner as for Sample 1, except for replacing (A-1) with 40 g (solid basis) of (A-5). This sample was designated as Sample 3.

For comparison, Sample C was prepared in the same manner as for Sample 1, except for replacing (A1) with 40 g (solid basis) of (A-6).

Various performance properties of Samples 3 and C were evaluated in the same manner as in Example 1. The results obtained are shown in Table 2 below.

TABLE 2

| | Sample 3 | Sample C |
|---|---|---|
| Binder Resin | (A-5) | (A-6) |
| $V_{10}$ (−V) | 560 | 540 |
| DRR (%) | 92 | 82 |
| $E_{1/10}$ (lux.sec) | 5.4 | 12.0 |
| Image Forming Performance (Condition II) | good | no good ($D_{max}$ was unmeasurable; cut-off of thin lines was observed) |
| Printing Durability | 8000 | Cut-off of thin lines or letters was observed from the start of printing. |

Sample C wherein (A-6), a conventional random copolymer, was used as binder resin showed deteriorated surface smoothness. Although it exhibited satisfactory electrostatic characteristics at ambient temperature and humidity, the photosensitivity was inferior. Besides, image formation effected under severer conditions of a high temperature (30° C.) and a high humidity (80% RH) only produced a reproduced image which was deteriorated.

When an offset printing plate produced therefrom was used for printing, the resulting prints involved cut-off of thin lines or letters.

On the other hand, Sample 3 according to the present invention had a smooth surface and exhibited excellent charging properties, dark charge retention, and photosensitivity. Further, it served as a printing plate precursor providing a clear reproduced image free from background fog or occurrence of cut-off of thin lines even when exposed to high temperature and high humidity conditions. The offset printing plate produced therefrom could produce a large number of prints.

From these results, it would be safe to infer that the location of the acidic group in the binder resin has a great influence upon the dispersion state of photoconductive particles, e.g., zinc oxide, and, in this sense, the superiority of the photoreceptor of the present invention can be attributed to the specific binder resin used in this invention.

EXAMPLES 4 TO 9

Resins (A-7) to (A-12) were synthesized in the same manner as for (A-4) of Example 2, except for replacing the thioglycolic acid used as a chain transfer agent with each of the compounds shown in Table 3. The weight average molecular weight of the resulting resin is also shown in Table 3.

TABLE 3

| Example No. | Resin | Chain Transfer Agent | Weight Average Molecular Weight |
|---|---|---|---|
| 4 | (A-7) | $HS(CH_2)_2—COOH$ | 8,300 |
| 5 | (A-8) | $HS—CH(CH_2—COOH)—COOH$ | 7,600 |
| 6 | (A-9) | 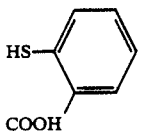 | 7,700 |
| 7 | (A-10) | $HSCH_2CH_2SO_3H$ | 7,600 |

TABLE 3-continued

| Example No. | Resin | Chain Transfer Agent | Weight Average Molecular Weight |
|---|---|---|---|
| 8 | (A-11) | $HS(CH_2)_3O—P(=O)(OH)—OH$ | 7,800 |
| 9 | (A-12) | $HS(CH_2)_2O—P(=O)(OC_2H_5)—OH$ | 8,000 |

An electrophotographic photoreceptor was prepared using each of the resulting binder resins in the same manner as in Example 2. As a result of evaluations, each of the photoreceptors were proved excellent not only in charging properties, dark charge retention, and photosensitivity but also in image reproducibility to provide a clear reproduced image involving neither background fog nor cut-off of a thin line image even when exposed to severe environmental conditions of high temperature and high humidity (30° C., 80% RH).

EXAMPLE 10 AND COMPARATIVE EXAMPLE 3

A solution of 48.5 g of ethylene methacrylate, 48.5 g of benzyl methacrylate and 1.0 g of thioglycolic acid in 200 g of toluene was heated at 90° C. in a nitrogen stream, and 3 g of ABCV was added thereto to effect copolymerization for 8 hours. The resulting copolymer resin (A-13) had a weight average molecular weight of 18,000 and a glass transition point of 50° C.

A mixture of 40 g (solid basis) of (A-13), 200 g of zinc oxide, 0.02 g of heptamethinecyanine dye of formula shown below, 0.15 g of phthalic anhydride, and 300 g of toluene was dispersed in a ball mill for 2 hours to prepare a photosensitive coating composition. An electrophotographic photoreceptor was prepared from the resulting coating composition in the same manner as in Example 1. This sample was designated as Sample 10.

Cyanine Dye

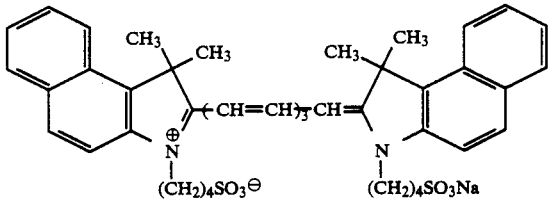

For comparison, a mixture of 48.5 g of ethyl methacrylate, 48.5 g of benzyl methacrylate, 3 g of methacrylic acid, and 200 g of toluene was heated at 90° C. in a nitrogen stream, and 3.0 g of azobisisobutyronitrile was added thereto to effect copolymerization for 8 hours. The resulting resin (A-14) had a weight average molecular weight of 15,000 and a glass transition point of 54° C. Sample D was prepared in the same manner as in Example 9, except for replacing (A-13) with (A-14).

Each of Samples 10 and D was evaluated for surface smoothness and electrostatic characteristics in the same manner as in Example 1, and the results obtained are shown in Table 4. In the determination of electrostatic characteristics, a gallium-aluminumarsenic semiconductor laser (oscillation wavelength: 830 nm) was used as a light source.

TABLE 4

| | Sample 10 | Sample D |
|---|---|---|
| Surface Smoothness (sec/cc) | 80 | 60 |
| $V_{10}$ (−V) | 560 | 510 |
| DRR (%) | 91 | 50 |
| $E_{1/10}$ (erg/cm$^2$) | 56 | 50 |

As is apparent from Table 4, Sample D had poor surface smoothness and considerably reduced dark charge retention (DRR). The seemingly small $E_{1/10}$ indicating high photosensitivity is ascribed to the low DRR. The DRR of Sample D was even lower than that of Sample A. This indicates that the conventional resins used in these comparative samples are highly susceptible to influences from sensitizing dyes used in combination. To the contrary, the binder resin of the present invention provides a photoreceptor excellent in every electrostatic characterisitc, i.e., charging properties, dark charge retention, and photosensitivity, regardless of the chemical structure of sensitizing dyes.

EXAMPLES 11 AND 12 COMPARATIVE EXAMPLES E TO I

Synthesis of Resin (B-1):

A solution of 100 g of ethyl methacrylate in 200 g of toluene was heated at 80° C. in a nitrogen stream, and 1 g of 2,2'-azobis(1-cyclohexanecarbonitrile) was added thereto to effect polymerization for 10 hours. The resulting resin (B-1) had a weight average molecular weight of 140,000 and a glass transition point of 48° C.

Synthesis of Resin (B-2):

A solution of 100 g of ethyl methacrylate and 200 g of toluene was heatd at 70° C. in a nitrogen stream, and 2 g of 2,2'-azobis(4-cyanoheptanol) was added thereto to effect polymerization for 8 hours. To the resulting polymerization mixture were added 0.92 g of glutaric acid anhydride and 1 g of pyridine, and the mixture was further allowed to react at 80° C. for 10 hours. The resulting resin (B-2) had a weight average molecular weight of 105,000 and a glass transition point of 47° C.

A mixture of 20 g (solid basis) of (A-1) as synthesized in Example 1, 20 g of polyethyl methacrylate (weight average molecular weight: 140,000), 200 g of zinc oxide, 0.07 g of tetrabromophenol blue, 0.20 g of phthalic anhydride, and 300 g of toluene was dispersed in a ball mill for 2 hours to prepare a photosensitive coating composition. The composition was coated on a paper support having been rendered conductive with a wire bar to a dry thickness of 25 g/m$^2$ and dried at 110° C. for 1 minute. The coating was allowed to stand in a dark place at 20° C. and 65% RH for 24 hours to obtain an electrophotographic photoreceptor. This photoreceptor was designated as Sample 11.

Sample 12 was prepared in the same manner for Sample 11, except for replacing all the binder resin with 40 g (solid basis) of (A-1) as a sole binder component.

Sample E was prepared in the same manner as for Sample 11, except for replacing all the binder resin with 40 g (solid basis) of (A-2).

Sample F was prepared in the same manner as for Sample 11, except for replacing all the binder resin with 20 g of (A-2) and 20 g of polyethyl methacrylate (weight average molecular weight: 140,000).

Sample G was prepared in the same manner as for Sample 11, except for replacing all the binder resin with 20 g (solid basis) of (A-2) and 20 g of an ethyl methacrylate-acrylic acid copolymer (98/2 by weight; weight average molecular weight: 74,000).

Sample H was prepared in the same manner as for Sample 11, except for replacing all the binder resin with 40 g of an ethyl methacrylate-acrylic acid copolymer (98/2 by weight; weight average molecular weight: 74,000).

Sample I was prepared in the same manner as for Sample 11, except for replacing all the binder resin with 20 g (solid basis) of (A-1) and 20 g (solid basis) of (B-2).

Each of Samples 11 to 12 and E to I was evaluated in the same manner as in Example 1. The results obtained are shown in Table 5 below.

TABLE 5

| | Sample 11 | Sample 12 | Sample F | Sample F | Sample G | Sample H | Sample I |
|---|---|---|---|---|---|---|---|
| Surface Smoothness (sec/cc) | 95 | 83 | 83 | 96 | 60 | 38 | 85 |
| $V_{10}$ (−V) | 550 | 520 | 525 | 540 | 500 | 510 | 530 |
| DRR (%) | 96 | 97 | 85 | 83 | 75 | 70 | 86 |
| $E_{1/10}$ (lux.sec) | 3.5 | 3.0 | 8.5 | 9.0 | 9.5 | 7.0 | 8.5 |
| Image Formation Performance: | | | | | | | |
| Condition I | good | good | good | good | good | good | good |
| Condition II | good | good | good | good | no good ($D_{max}$ unmeasurable; cut-off of thin lines) | no good ($D_{max}$ unmeasurable; cut-off of thin lines) | good |
| Contact Angle with Water (°) | 13 | 12 | 13 | 15 | 35 | 30–40 (widely scattered) | 25 |
| Background Stain Resistance: | | | | | | | |
| Condition I | excellent | excellent | excellent | excellent | very poor | very poor | no good |
| Condition II | good | good | good | good | extremely poor | extremely poor | poor |
| Printing Durability | more than 10000 | 3500 | 3500 | more than 10000 | background stains were observed from the start of printing | background stains were observed from the start of printing | 3000 |

As is apparent from Table 5, Sample 11 according to the preferred embodiment of the present invention exhibited satisfactory surface smoothness and electrostatic characteristics. When used as an offset master plate precursor, Sample 11 provided a clear reproduced image free from background fog. These results seem attributable to the fact that the binder resin is sufficiently adsorbed on the photoconductive particles to cover the surfaces thereof, while sufficiently maintaining the mutual action among binder resins. Based on the same reason, oil-desensitization with an oil-desensitizing solution sufficiently proceeded to make the non-image area sufficiently hydrophilic as proved by the small contact angle with water of 15° or less. On printing, background stains of prints were not observed at all, and printing durability exceeding 10,000 prints could be attained.

Sample 12, wherein the resin (A) is used alone, though implicit in the present invention, exhibited reduced printing durability as compared with Sample 1.

Sample E exhibited low printing durability and low photosensitivity. Sample F was, though satisfactory in printing durability, inferior in dark charge retention to Samples 11 and 12.

Samples G to I were inferior in electrostatic characteristics, particularly DRR and $E_{1/10}$. When they were used as an offset master plate precursor, the resulting master plates proved liable to cause background stains, having printing durability of about 3,000 at the most.

From all these considerations, it can be seen that the binder resin of the present invention provides an electrophotographic photoreceptor satisfying electrostatic requirements and printing requirements.

EXAMPLE 13

An electrophotographic photoreceptor was prepared in the same manner as in Example 11, except for using 15 g (solid basis) of (A-4) as synthesized in Example 2 and 25 g of polybutyl methacrylate (weight average molecular weight: 180,000). As a result of evaluations conducted in the same manner as in Example 1, the photoreceptor was found to have a surface smoothness of 80 sec/cc, $V_{10}$ of −560 V, DRR of 93%, and $E_{1/10}$ of 3.5 lux.sec, and exhibit satisfactory image formation performances at a severe condition of 38° C. and 80% RH. That is, the photoreceptor according to the present invention was excellent in charging properties, dark decay retention and photosensitivity. When the photoreceptor was used as an offset master plate precursor, the reproduced image was clear and free from background stains or cut-off of thin lines even when processed under severe conditions of high temperature (30° C.) and high humidity (80% RH). An offset master plate produced therefrom provided on printing more than 10,000 prints having a clear image free from background stains.

EXAMPLES 14 TO 19

An electrophotographic photoreceptor was prepared in the same manner as in Example 13, except for replacing (A-4) with each of (A-7) to (A-12) as synthesized in Examples 4 to 9. Each of the resulting photoreceptors was tested in the same manner as described in Example 13 and found that the photoreceptor was excellent in charging properties, dark decay retention and photosensitivity. When the photoreceptor was used as an offset master plate precursor, the reproduced image was clear and free from background stains or cut-off of thin lines even when processed under severe conditions of high temperature (30° C.) and high humidity (80% RH).

EXAMPLE 20

A solution of 95 g of benzyl methacrylate in 200 g of toluene was heated at 95° C in a nitrogen stream, and 5 g of 2,2'-azobis(4-cyanoheptanol) was added thereto to effect reaction for 8 hours. The temperature was set at 85° C., and 1.2 g of succinic anhydride and 1 g of pyridine were added thereto to allow the mixture to further react for 10 hours. The resulting resin (A-15) had a weight average molecular weight of 8,500 and a glass transition point of 38° C.

An electrophotographic photoreceptor was prepared in the same manner as in Example 13, except for replacing (A-4) as used in Example 13 with (A-15). As a result of evaluations conducted in the same manner as in Example 1, the resulting photoreceptor proved excellent in charging properties, dark charge retention, and photosensitivity. When it was used as an offset master plate precursor, it formed a clear reproduced image free from background stains or cut-off of thin lines even when processed under severe conditions of high temperature and high humidity (30° C., 80% RH). An offset master print obtained therefrom provided on printing more than 10,000 prints having a clear image free from background stains.

EXAMPLES 21 AND COMPARATIVE EXAMPLE J

Synthesis of Resin (A-16):

A mixed solution of 48.5 g of ethylene methacrylate, 45.5 g of benzyl methacrylate, 4.0 g of thioglycolic acid, and 200 g of toluene was heated at 90° C. in a nitrogen stream, and 1 g of ABCV was added thereto to effect reaction for 8 hours. The resulting resin (A-16) had a weight average molecular weight of 83,000 and a glass transition point of 43° C.

Synthesis of Resin (A-17):

A mixed solution of 48.5 g of ethyl methacrylate, 43.5 g of benzyl methacrylate, 5 g of methacrylic acid, and 200 g of toluene was heated at 100° C. in a nitrogen stream, and 6.0 g of azobisisobutyronitrile was added thereto to effect reaction for 8 hours. The resulting resin (A-17) had a weight average molecular weight of 8,000 and a glass transition point of 43° C.

A mixture of 10 g (solid basis) of (A-16), 20 g of polyethyl methacrylate (weight average molecular weight: 80,000), 200 g of zinc oxide, 0.02 g of the same heptamethinecyanine dye as used in Example 10, 0.15 g of phthalic anhydride, and 300 g of toluene was dispersed in a ball mill for 2 hours to prepare a photosensitive coating composition. An electrophotographic photoreceptor was prepared by using the resulting coating composition in the same manner as in Example 11. This sample was designated as Sample 21.

For comparison, Sample J was prepared in the same manner as for Sample 21, except for replacing (A-16) with (A-17).

Each of Samples 21 and J was evaluated for surface smoothness and electrostatic characteristics in the same manner as in Example 1, except that a gallium-aluminum-arsenic semiconductor laser (oscillation wavelength: 830 nm) was used as a light source. The results obtained are shown in Table 6 below.

TABLE 6

| | Sample 21 | Sample J |
|---|---|---|
| Surface Smoothness (sec/cc) | 80 | 80 |
| $V_{10}$ (−V) | 560 | 550 |
| DRR (%) | 97 | 86 |
| $E_{1/10}$ (erg/cm$^2$) | 38 | 50 |

Making a comparison with Sample G, it can be seen that Sample J is inferior in DRR. This means that the conventionally known resins are considerably susceptible to influences from the kind of a spectral sensitizing dye used in combination. To the contrary, the binder resin of the present invention retains excellent performance characteristics in charging properties, dark charge retention, and photosensitivity irrespective of the chemical structure of spectral sensitizing dyes.

EXAMPLES 22 TO 26

An electrophotographic photoreceptor was prepared in the same manner as for Sample 21 of Example 21, except for using (A-1) as synthesized in Example 1 and each of the resins shown in Table 7 below at a ratio of 1:1 by weight. Each of the resulting photoreceptors was evaluated in the same manner as in Example 21. The results obtained are also shown in Table 7.

In Table 7, the film strength was determined in terms of the mechanical strength of the photoconductive layer according to the following procedure.

The surface of each photosensitive material was repeatedly rubbed 1,000 times with an emery paper (fillet) of #1000 under a load of 50 g/cm$^2$ using a Heidon 14 type surface test machine (product of Shinto Kagaku K.K.). After removing powders formed by rubbing, the weight loss of the photosensitive material was measured, and the mechanical strength was determined based on the film remaining (%).

TABLE 7

| Example No. | Resin | Surface Smoothness (sec/cc) | Film Strength (%) | $V_{10}$ (−V) | DRR (%) | $E_{1/10}$ (erg/cm$^2$) | Film Formation Performance (Condition II) |
|---|---|---|---|---|---|---|---|
| 22 | polyvinyl butyral | 105 | 93 | 560 | 90 | 33 | good |
| 23 | polyvinyl acetate | 110 | 95 | 570 | 91 | 35 | good |
| 24 | styrene/ethyl methacrylate copolymer (20/80 by weight) | 105 | 96 | 545 | 87 | 28 | good |
| 25 | styrene/butadiene copolymer (25/75 by weight) | 95 | 96 | 550 | 88 | 37 | good |
| 26 | methyl methacrylate/butyl methacrylate (4/6 by weight) | 87 | 94 | 555 | 94 | 24 | good |

As is demonstrated by Table 7, each of the photoreceptors according to the present invention is satisfactory in film strength and electrostatic characteristics and, when processed even under a high temperature and high humidity condition (30° C., 80% RH), forms a clear reproduced image free from background stains.

EXAMPLES 27 AND 28 AND COMPARATIVE EXAMPLES K TO O

Synthesis of Resin (C-1):

A mixed solution of 95 g of ethyl methacrylate, 5 g of N,N-dimethylaminoethyl methacrylate, and 200 g of toluene was heated at 80° C. in a nitrogen stream, and 1 g of 2,2'-azobis(1-cyclohexanecarbonitrile) was added thereto to effect reaction for 10 hours. The resulting copolymer resin (C-1) had a weight average molecular weight of 140,000 and a glass transition point of 48° C.

Synthesis of Resin (C-2):

A mixed solution of 95 g of ethyl methacrylate, 5 g of acrylic acid, and 200 g of toluene was allowed to react under the same conditions as described above. The resulting copolymer (C-2) had a weight average molecular weight of 108,000 and a glass transition point of 50° C.

Synthesis of Resin (C-3):

A mixed solution of 100 g of ethyl methacrylate and 200 g of toluene was heated at 70° C. under a nitrogen stream, and 2 g of 2,2'-azobis(4-cyanoheptanol) was added thereto to effect reaction for 8 hours. To the resulting reaction mixture were added 0.92 g of glutaric anhydride and 1 g of pyridine, and the mixture was allowed to further react at 80° C. for 10 hours. The resulting copolymer resin (C-3) had a weight average molecular weight of 105,000 and a glass transition point of 47° C.

A mixture of 18 g (solid basis) of Resin (A-1) as produced in Example 1, 22 g of (C-1), 200 g of zinc oxide, 0.07 g of tetrabromophenol blue, 0.15 g of phthalic anhydride and 300 g of toluene was dispersed in a ball mill for 2 hours to prepare a photosensitive coating composition. The composition was coated on a paper support having been rendered conductive with a wire bar to a dry thickness of 25 g/m$^2$ and dried at 110° C. for 1 minute. The coating was allowed to stand in a dark place at 20° C. and 65% RH for 24 hours to prepare an electrophotographic photoreceptor (designated as Sample 27).

Sample 28 was prepared in the same manner as for Sample 27, except for replacing all the binder resin with 40 g (solid basis) of Resin (A-1) alone.

Sample K was prepared in the same manner as for Sample 27, except for replacing all the binder resin with 40 g (solid basis) of (A-2) as synthesized in Example 1.

Sample L was prepared in the same manner as for Sample 27, except for replacing all the binder resin with 18 g (solid basis) of (A-2) and 22 g (solid basis) of (C-1) as synthesized in Example 27.

Sample M was prepared in the same manner as for Sample 27, except for replacing all the binder resin with 40 g (solid basis) of (C-1) alone.

Sample N was prepared in the same manner as for Sample 27, except for replacing all the binder resin with 40 g of an ethyl methacrylate/acrylic copolymer (98/2; weight average molecular weight: 74,000) alone.

Sample O was prepared in the same manner as for Sample 27, except for replacing all the binder resin with 18 g (solid basis) of (A-2) and 22 g (solid basis) of (C-2) as synthesized in Example 27.

Each of Samples 27, 28 and K to O was evaluated for various performance properties in the same manner as in Example 1. The results obtained are shown in Table 8 below.

TABLE 8

| | Sample 27 | Sample 28 | Sample K | Sample L | Sample M | Sample N | Sample O |
|---|---|---|---|---|---|---|---|
| Surface Smoothness (sec/cc) | 95 | 83 | 83 | 90 | 60 | 80 | 20 |
| V (−V) | 550 | 520 | 530 | 510 | 450 | 500 | 450 |
| DRR (%) | 96 | 97 | 85 | 83 | 65 | 80 | 50 |
| $E_{1/10}$ (lux.sec) | 3.6 | 3.0 | 8.5 | 9.0 | 3.0 | 6.0 | 1.0 |
| Image Formation Performance: | | | | | | | |
| Condition I | good | good | good | good | good | good | not good ($D_{max}$ was unmeasured) |
| Condition II | good | good | good | good | no good ($D_{max}$ was unmeasurable) cut-off of thin lines was observed) | good | no good ($D_{max}$ was unmeasurable) cut of thin lines was observed) |
| Contact Angle with Water (°) | 13 | 12 | 13 | 15 | 35 | 18 | 30–40 (widely scattered) |
| Background Stain Resistance: | | | | | | | |
| Condition I | excellent | excellent | excellent | excellent | very poor | good | very poor |
| Condition II | good | good | good | good | extremely poor | no good | extremely poor |
| Printing | more than 10000 | 3500 | 3500 | 8000 | background stains were observed from the start of printing | slight background stains were observed from the start of printing | background stains were observed from the start of printing |

As is shown in Table 8, Sample 27 according to the preferred embodiment of the present invention was satisfactory in surface smoothness and electrostatic characteristics and reproduced a clear image free from background fog. Such superiority is assumed to be attributed to the fact that the binder resin is sufficiently adsorbed to the photoconductive particles to cover the surface of the particles while sufficiently retaining the mutual action among binders. For the same reason, when it was processed as an offset master plate precursor, oil-desensitization with an oil-desensitizing solution sufficiently proceeds to render the non-image area hydrophilic as proved by the small contact angle with water of 15° or less. When the offset master plate was used for printing, no background stains were observed at all in the resulting prints, and printing durability exceeded 10,000 prints.

As compared with Sample 27, Sample 28 in which the resin (A) was used alone exhibited reduced printing durability.

Sample K had reduced printing durability and reduced photosensitivity. Sample L, though satisfactory in printing durability, showed low DRR as compared with the samples of the present invention. Samples M to O exhibited deteriorated electrostatic characteristics, particularly DRR and $E_{1/10}$, and, when applied as an offset master plate precursor, easily caused background stains, only attaining printing durability of about 3,000 prints at the most.

From these results, it can be seen that the combined use of the resin (A') and the resin (C) according to the present invention provides an electrophotographic photoreceptor having further improved electrostatic characteristics and printing suitability.

EXAMPLE 29

An electrophotographic photoreceptor was prepared in the same manner as for Sample 27, except for using 15 g (solid basis) of (A-4) as synthesized in Example 2 and 25 g of a butyl methacrylate/2-hydroxyethyl methacrylate copolymer (9/1 by weight; weight average molecular weight: 53,000). The resulting photoreceptor was evaluated in the same manner as in Example 27 and was found to have a surface smoothness of 80 sec/cc, $V_{10}$ of −520 V, DRR of 93%, and $E_{1/10}$ of 3.0 lux.sec and exhibited satisfactory image formation performance under severe condition (30° C., 80% RH).

That is, the photoreceptor was excellent in charging properties, dark charge retention and photosensitivity and formed a reproduced image clear and free from background stains or cut-off of thin lines even under a severe condition of high temperature (30° C.) and high humidity (80% RH). Further, an offset master plate obtained therefrom could produce more than 10,000 prints clear and free from background stains.

EXAMPLES 30 TO 35

An electrophotographic photoreceptor was prepared in the same manner as in Example 29, except for replacing (A-4) with each of (A-7) to (A-12) as synthesized in Examples 4 to 9. Each of the resulting photoreceptors exhibited excellent characteristics.

EXAMPLE 36

An electrophotographic photoreceptor was prepared in the same manner as in Example 29, except for replacing (A-4) with 15 g of (A-15) as synthesized in Example 20. The resulting photoreceptor was excellent in charging properties, dark charge retention and photosensitivity and formed a reproduced image which was clear and free from background stains or cut-off of thin lines even under a severe condition of high temperature (30° C.) and high humidity (80% RH). When the resulting offset master plate was used for printing, more than 10,000 clear prints free from background stains could be obtained.

EXAMPLES 37 AND COMPARATIVE EXAMPLE P

A mixture comprising 15 g (solid basis) of (A-16) as synthesized in Example 21, 25 g of a benzyl methacrylate/N,N-dimethylaminophenyl methacrylate copolymer (9/1 by weight; weight average molecular weight: 6,500), 200 g of zinc oxide, 0.02 g of the same heptamethinecyanine dye as used in Example 10, 0.15 g of phthalic anhydride, and 300 g of toluene was dispersed in a ball mill for 2 hours to prepare a photosensitive coating composition. An electrophotographic photoreceptor was produced by using the thus prepared coating composition in the same manner as in Example 27. This photoreceptor was designated as Sample 37.

For comparison, Sample P was prepared in the same manner as for Sample 27, except for replacing (A-16) with (A-17) as used in Sample J.

Each of Samples 37 and P was evaluated for surface smoothness and electrostatic characteristics in the same manner as in Example 27, except for using a gallium-aluminum-arsenic semiconductor laser (oscillation wavelength: 830 nm) as a light source. The results obtained are shown in Table 9 below.

TABLE 9

| | Sample 37 | Sample P |
|---|---|---|
| Surface Smoothness (sec/cc) | 80 | 80 |
| $V_{10}$ (−V) | 560 | 555 |
| DRR (%) | 97 | 86 |
| $E_{1/10}$ (erg/cm$^2$) | 38 | 50 |

It can be seen that Sample P is inferior to the above-described Sample L in DRR. This means that the conventionally known resins are severely susceptible to influences from the spectral sensitizing dyes to be used in combination. On the other hand, the binder resin of the present invention provides a photoreceptor excellent in charging properties, dark charge retention as well as photosensitivity regardless of the change of spectral sensitizing dyes in chemical structure.

EXAMPLES 38 TO 50

An electrophotographic photoreceptor was prepared in the same manner as in Example 37, except for using each of the resins used in Examples 27 to 37 as the resin (A') and each of the resins shown in Table 10 below as the resin (C) at a weight ratio of 1:1. Each of the resulting photoreceptors was evaluated for surface smoothness and electrostatic characteristics in the same manner as in Example 37. The results obtained are shown in Table 11 below.

TABLE 10

| Resin (C) | Monomer Composition (weight Ratio) | | | Wt. Average Molecular Weight (× $10^4$) |
|---|---|---|---|---|
| (C-4) | n-butyl methacrylate (95) | 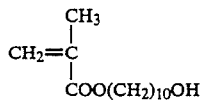 | (5) | 3.8 |
| (C-5) | n-butyl methacrylate (98) | 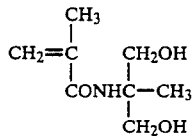 | (2) | 4.0 |
| (C-6) | n-butyl methacrylate (95) | 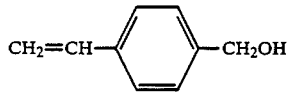 | (5) | 3.7 |
| (C-7) | n-butyl methacrylate (95) | 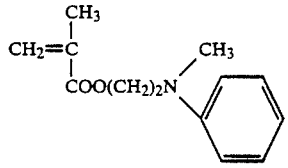 | (5) | 4.2 |
| (C-8) | n-butyl methacrylate (94) | 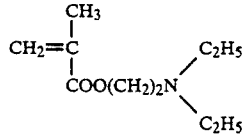 | (6) | 4.3 |
| (C-9) | n-butyl methacrylate (96) | 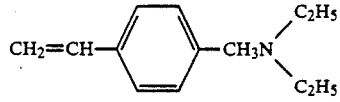 | (4) | 3.8 |

TABLE 10-continued

| Resin (C) | Monomer Composition (weight Ratio) | | | Wt. Average Molecular Weight (× $10^4$) |
|---|---|---|---|---|
| (C-10) | n-butyl methacrylate (94) | 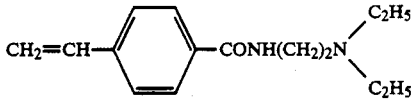 | (6) | 3.8 |
| (C-11) | n-butyl methacrylate (95) | 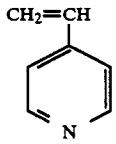 | (5) | 4.0 |
| (C-12) | n-butyl methacrylate (90) | 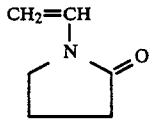 | (10) | 4.2 |
| (C-13) | n-butyl methacrylate (92) | 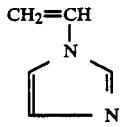 | (8) | 4.0 |

TABLE 11

| Example No. | Resin (A') | Resin (C) | Surface Smoothness | $V_{10}$ (−V) | DRR (%) | $E_{1/10}$ (erg/cm$^2$) |
|---|---|---|---|---|---|---|
| 38 | (A-1) | (C-4) | 105 | 580 | 94 | 30 |
| 39 | (A-1) | (C-5) | 110 | 590 | 90 | 33 |
| 40 | (A-1) | (C-6) | 105 | 580 | 96 | 35 |
| 41 | (A-7) | (C-7) | 100 | 550 | 94 | 26 |
| 42 | (A-7) | (C-8) | 105 | 560 | 95 | 23 |
| 43 | (A-8) | (C-9) | 100 | 560 | 91 | 25 |
| 44 | (A-9) | (C-10) | 100 | 560 | 90 | 34 |
| 45 | (A-9) | (C-11) | 110 | 570 | 95 | 31 |
| 46 | (A-10) | (C-12) | 105 | 600 | 89 | 29 |
| 47 | (A-9) | (C-4) | 105 | 550 | 93 | 28 |
| 48 | (A-11) | (C-13) | 100 | 550 | 96 | 31 |
| 49 | (A-12) | (C-7) | 105 | 570 | 94 | 27 |
| 50 | (A-9) | (C-13) | 110 | 560 | 97 | 28 |

Table 11 reveals that each of the photoreceptors according to the present invention is excellent in surface smoothness, charging properties, dark charge retention, and photosensitivity. When these photoreceptors were electrophotographically processed as offset master plate precursor, a clear image free from background stains could be reproduced in every case even under a high temperature and high humidity condition (30° C., 80% RH).

EXAMPLES 51 AND 52 AND COMPARATIVE EXAMPLES Q TO R

Synthesis of Resin (A-17):

A mixed solution of 95 g of ethyl acrylate, 200 g of toluene, and 50 g of isopropyl alcohol was heated at 85° C. under a nitrogen stream, and 5 g of ABCV was added thereto to effect reaction for 10 hours. The resulting resin (A-17) had a weight average molecular weight of 8,600 and a glass transition point of 46° C.

Synthesis of Resin (A-18):

A mixed solution of 95 g of ethyl methacrylate, 5 g of acrylic acid, and 200 g of toluene was heated at 90° C. in a nitrogen stream, and 6 g of 2,2'-azobis(2,4-dimethylvaleronitrile) was added thereto to effect reaction for 10 hours. The resulting resin (A-18) had a weight average molecular weight of 7,800 and a glass transition point of 45° C.

Synthesis of Resin (D-1):

A mixed solution of 98 g of ethyl methacrylate, 2 g of a monomer of formula shown below, 200 g of toluene, and 30 g of isopropyl alcohol was heated at 85° C. in a nitrogen stream, and 2.0 g of 2,2'-azobis(1-cyclohexanecarbonitrile) was added thereto to effect reaction for 10 hours. The resulting copolymer resin (D-1) had a weight average molecular weight of 54,000 and a glass transition point of 48° C.

Monomer

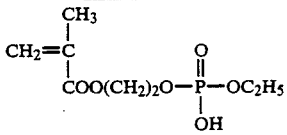

Synthesis of Resin (D-2):

A mixed solution of 97 g of ethyl methacrylate, 3 g of acrylic acid, and 200 g of toluene was allowed to react under the same conditions as for Resin (D-1). The resulting copolymer resin (D-2) had a weight average molecular weight of 80,000 and a glass transition point of 48° C.

A mixture comprising 8 g (solid basis) of (A-17), 32 g (solid basis) of (D-1), 200 g of zinc oxide, 0.03 g of tetrabromophenol, 0.03 g of Rose Bengale, 0.05 g of maleic anhydride, and 300 g of toluene was dispersed in a ball mill for 2 hours to prepare a photosensitive coating composition. The coating composition was coated on a paper support having been rendered conductive with a wire bar to a dry thickness of 25 g/m$^2$ and dried at 110° C. for 1 minute. Then, the coating was allowed to stand in a dark place at 20° C. and 65% RH for 24 hours to prepare an electrophotographic photoreceptor. The resulting photoreceptor was designated as Sample 51.

Sample 52 was prepared in the same manner as for Sample 51, except for replacing (A-17) and (D-1) with 40 g (solid basis) of (A-17).

For comparison, Sample Q was prepared in the same manner as for Sample 51, except for replacing (A-17) and (D-1) with 40 g (solid basis) of (D-2) as a sole binder resin.

For further comparison, Sample R was prepared in the same manner as for Sample 51, except for replacing (A-17) and (D-1) with 8 g (solid basis) of (A-18) and 32 g (solid basis) of (D-2).

Each of Samples 51, 52, Q, and R was evaluated in the same manner as in Example 1. The results obtained are shown in Table 12.

TABLE 12

| | Sample 51 | Sample 52 | Sample Q | Sample R |
|---|---|---|---|---|
| Surface Smoothness (sec/cc) | 96 | 85 | 35 | 50 |
| $V_{10}$ (−V) | 560 | 530 | 450 | 540 |
| DRR (%) | 97 | 97 | 65 | 80 |
| $E_{1/10}$ (lux.sec) | 3.6 | 3.0 | 2.5 | 5.0 |
| Image Formation Performance: | | | | |
| Condition I | good | good | no good ($D_{max}$ was unmeasurable) of thin lines was observed) | good |
| Condition II | good | good | poor ($D_{max}$ was unmeasurable) | no good ($D_{max}$ was unmeasurable) |
| Contact Angle with Water (°) | 12 | 12 | 30–40 (widely scattered) | 25–30 (widely scattered) |
| Background Stain Resistance: | | | | |
| Condition I | excellent | excellent | very poor | very poor |
| Condition II | good | good | extremely poor | extremely poor |
| Printing Durability | more than 10000 | 3500 | background stains were observed from the start of printing | background stains were observed from the start of printing |

As is shown in Table 12, Sample 51, in which the resin (A) was used in combination with the resin (D) according to the preferred embodiment of the present invention, exhibited satisfactory surface smoothness and electrostatic characteristics and reproduced a clear image free from background stains. Thus, it can be assumed that the binder resin is sufficiently adsorbed on the photoconductive substance to cover the surface of the particles while sufficiently retaining the mutual action among binders. When Sample 51 was applied as an offset master plate precursor, oil-desensitization with an oil-desensitizing solution satisfactorily proceeded to sufficiently render the non-image area hydrophilic as proved by the small contact angle with water of 15° or less. On actual printing by using an offset master plate obtained from Sample 51, no background stains on the prints were observed at all, and the printing durability exceeded 10,000 prints.

As compared with Sample 51, Sample 52, though included in the scope of the present invention, showed inferior printing durability.

Sample R proved inferior in DRR to the samples of the present invention.

Sample Q had a severely deteriorated surface smoothness and reduced electrostatic characteristics. The quality of the image reproduced on Sample Q was poor. Further, an offset master plate obtained from Sample Q showed a wide scatter in hydrophilic properties of the non-image area and caused background stains on prints from the start of printing.

From all these considerations, the combined use of the resin (A') and the resin (D) brings about further improved electrostatic characteristics and printing suitability.

EXAMPLE 53

A mixed solution of 95 g of ethyl methacrylate, 5 g of thioglycolic acid, 200 g of toluene, and 100 g of isopropyl alcohol was heated at 75° C. in a nitrogen stream, and 1.0 g of azobisisobutyronitrile was added thereto to effect reaction for 8 hours. The resulting resin (A-19) had a weight average molecular weight of 7,800 and a glass transiiton point of 46° C.

An electrophotographic photoreceptor was prepared in the same manner as in Example 51, except for replacing (A-17) and (D-1) with 10 g (solid basis) of (A-19) and 30 g (solid basis) of (D-1). The resulting photoreceptor was evaluated in the same manner as in Example 51 and was found to have a surface smoothness of 80 sec/cc, $V_{10}$ of −550 V, DRR of 96%, and $E_{1/10}$ of 3.5 lux.sec and exhibited satisfactory image forming performances under a condition of 3° C. and 80% RH.

That is, the photoreceptor was excellent in charging properties, dark charge retention and photosensitivity and reproduced a clear image free from background fog or cut-off of thin lines even under a severe condition of high temperature and high humidity (30° C., 80 RH). Further, when the photoreceptor was processed to obtain an offset master plate, the master plate could produce more than 10,000 prints having a clear image free from background stains.

EXAMPLES 54 TO 57

Resins (A-20) to (A-23) were synthesized in the same manner as for (A-19) of Example 53, except for replacing the thioglycolic acid used as a chain transfer agent with each of the compounds shown in Table 13.

TABLE 13

| Example No. | Resin | Chain Transfer Agent | Weight Average Molecular Weight |
|---|---|---|---|
| 54 | (A-20) | $HS-CH(CH_2-COOH)-COOH$ | 7,600 |
| 55 | (A-21) | 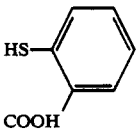 | 7,700 |
| 56 | (A-22) | $HSCH_2CH_2SO_3H$ | 7,600 |
| 57 | (A-23) | $HS(CH_2)_3O-P(=O)(OH)-OH$ | 7,800 |

An electrophotographic photoreceptor was prepared in the same manner as in Example 51, except for replacing (A-17) an (D-1) with 10 g (solid basis) of each of (A-20) to (A-23) of Table 13 and 30 g (solid basis) of (D-1).

Each of the resulting photoreceptors was evaluated in the same manner as in Example 51. As a result, all of these photoreceptors were proved excellent in charging properties, dark charge retention and photosensitivity. They reproduced a clear image free from background stains or cut-off of thin lines even under a servere condition of high temperature and high humidity (30° C., 80% RH). On printing, the offset master plates obtained from these samples produced more than 10,000 clear prints free from background stains.

EXAMPLES 58 TO 63

Resins (D-3) to (D-7) as the resin (D) were synthesized from the monomers shown in Table 14.

TABLE 14

| Resin No. | Monomer Composition (Weight Ratio) | | Weight Average Molecular Weight ($\times 10^4$) |
|---|---|---|---|
| (D-3) | ethyl methacrylate | (99.5) | 8.3 |
| | acrylic acid | (0.5) | |
| (D-4) | n-butyl methacrylate | (99.5) | 7.6 |
| | 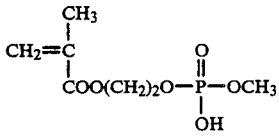 | (0.5) | |
| (D-5) | n-butyl methacrylate | (96) | 4.8 |
| | 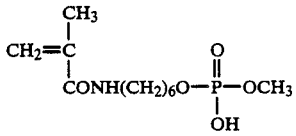 | (4) | |
| (D-6) | n-butyl methacrylate | (95) | 4.6 |
| | 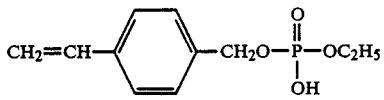 | (5) | |
| (D-7) | n-butyl methacrylate | (98.4) | 4.8 |
| | acrylic acid | (1.6) | |

An electrophotographic photoreceptor was prepared in the same manner as in Example 51, except for using each of the resins of Table 13 and each of the resins of Table 14 at a weight ratio of 1:3 as shown in Table 15 below. Each of the resulting photoreceptors was evaluated for electorstatic characteristics and image formation performance in the same manner as in Example 51. The results are shown in Table 15.

TABLE 15

| | Example No. | | | | | |
|---|---|---|---|---|---|---|
| | 58 | 59 | 60 | 61 | 62 | 63 |
| Binder Resin: | | | | | | |
| Resin (A) | A-20 | A-21 | A-22 | A-22 | A-23 | A-23 |
| Resin (D) | D-4 | D-3 | D-3 | D-4 | D-5 | D-7 |
| $V_{10}$ (−V) | 550 | 550 | 560 | 555 | 545 | 565 |
| DRR (%) | 93 | 92 | 91 | 94 | 90 | 93 |
| $E_{1/10}$ (lux.sec) | 4.2 | 3.8 | 3.2 | 4.0 | 3.1 | 3.5 |
| Image Formation Performance (30° C., 80% RH) | good | good | good | good | good | good |

It can be seen from Table 15 that the photoreceptors according to the present invention are excellent in charging properties, dark charge retention and photosensitivity and reproduce a clear image free from background stains or cut-off of thin lines even under a severe condition of high temperature and high humidity (30° C., 80% RH). Further, offset master plates obtained from these photoreceptors produce more than 10,000 clear prints free from background stains.

EXAMPLE 64

An electrophotographic photoreceptor was prepared in the same manner as in Example 53, except for replacing (A-19) with 10 g of (A-15) as synthesized in Example 20.

As a result of evaluations of the photoreceptor conducted in the same manner as in Example 51, the photoreceptor was found to be excellent in charging properties, dark charge retention and photosensitivity and enable to reproduce a clear image free from background stains or cut-off of thin lines even under a severe condition of high temperature and high humidity (30° C., 80% RH). When printing was carried out using the offset master plate produced therefrom, more than 10,000 prints free from background stains could be obtained.

EXAMPLE 65

A mixed solution of 94 g of n-propyl methacrylate, 6 g of 2-aminoethanethiol, 100 g of isopropyl alcohol, and 200 g of tetrahydrofuran was heated at 75° C. in a nitrogen stream, and 1.0 g of azobisisobutyronitrile was added thereto to effect reaction for 8 hours. After cooling, the reaction mixture was poured into 2 l of water to precipitate the reaction product. The solvent was removed by decantation, and the residue was dried at 40° C. under reduced pressure.

The resulting copolymer was dissolved in 200 g of toluene. After the temperature was raised to 90° C., 1.3 g of maleic anhydride and 1 g of pyridine were added thereto, followed by stirring to effect reaction for 10 hours. The resulting copolymer resin (A-24) had a weight average molecular weight of 6,200 and a glass transition point of 35° C.

An electrophotographic photoreceptor was prepared in the same manner as in Example 51, except for replacing (A-17) and (D-1) with 10 g (solid basis) of (A-24) and 30 g (solid basis) of (D-1). The resulting photoreceptor was evaluated as in Example 51, and substantially the same results as in Example 51 were obtained.

EXAMPLE 66 AND COMPARATIVE EXAMPLE S

A mixed solution of 48.5 g of ethyl methacrylate, 45.5 g of benzyl methacrylate, 4.0 g of thioglycolic acid, and 200 g of toluene was heated at 90° C. in a nitrogen stream, and 1 g of ABCV was added thereto to effect reaction for 8 hours. The resulting copolymer resin (A-25) had a weight average molecular weight of 8,300 and a glass transition point of 43° C.

A mixture comprising 8 g (solid basis) of (A-25), 32 g of (D-1), 200 g of zinc oxide, 0.02 g of heptamethinecyanine dye of formula shown below, 0.05 g of phthalic anhydride, and 300 g of toluene was dispersed in a ball mill for 2 hours to prepare a photosensitive coating composition. An electrophotographic photoreceptor was prepared from the coating composition in the same manner as in Example 51. This sample was designated as Sample 66.

Cyanine Dye

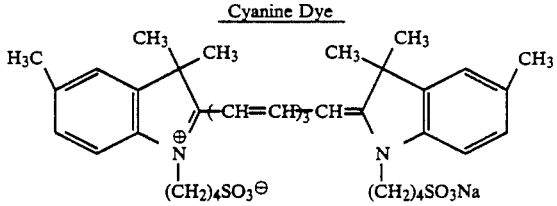

Separately, a mixed solution of 48.5 g of ethyl methacrylate, 43.5 g of benzyl methacrylate, 5 g of methacrylic acid, and 200 g of toluene was heated at 100° C. in a nitrogen stream, and 6.0 g of azobisisobutyronitrile was added thereto to effect reaction for 8 hours. The resulting copolymer (A-26) had a weight average molecular weight of 8,000 and a glass transition point of 43° C.

Sample S was prepared in the same manner as for Sample 66, except for replacing (A-25) with (A-26).

Each of Samples 66 and S was evaluated in the same manner as in Example 51 but using a gallium-aluminum-arsenic semiconductor laser (oscillation wavelength: 780 nm) as a light source. The results obtained are shown in Table 16.

TABLE 16

| | Sample 66 | Sample S |
|---|---|---|
| Surface Smoothness (sec/cc) | 80 | 80 |
| $V_{10}$ (−V) | 560 | 555 |
| DRR (%) | 92 | 75 |
| $E_{1/10}$ (erg/cm$^2$) | 38 | 50 |

Making a comparison between Sample S and Sample R, it can be seen that Sample S is further inferior to Sample R in DRR. This indicates that the conventionally known resins are considerably susceptible to influences of the kind of spectral sensitizing dyes to be used in combination. To the contrary, the binder resin according to the present invention stably provides an electrophotographic photoreceptor excellent in charging properties and dark charge retention as well as photosensitivity even if the chemical structure of the sensitizing dye is greatly altered.

As described above, the present invention provides an electrophotographic photoreceptor exhibiting excellent performance properties in film surface smoothness, film strength, electrostatic characteristics, image formation performance, and printing suitability including background stain resistance and printing durability. In addition, the excellent smoothness of the photoconductive layer as well as various electrostatic characteristics can be retained irrespective of the kind of sensitizing dyes to be used in combination with the photoreceptor.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a support having thereon at least one photoconductive layer containing at least an inorganic photoconductive substance and a binder resin, wherein said binder resin contains a resin (A) having at least one kind of acidic group selected from the group consisting of —$PO_3H_2$, —$SO_3H$, and —COOH at the terminal end of the main chain of the resin, but not in the side chains linked to the main chain, wherein said resin (A) has a weight average molecular weight of from $1\times10^3$ to $3\times10^4$ and wherein the acidic group is present in resin (A) at a ratio of from 0.1 to 10 parts by wight per 100 parts by weight of the resin.

2. An electrophotographic photoreceptor as claimed in claim 1, wherein said resin (A) has a weight average molecular weight of from $1\times10^3$ to $1.5\times10^4$ and said binder resin further contains (B) a resin having a weight average molecular weight of from $1\times10^4$ to $5\times10^5$ but containing none of $-PO_3H_2$, $-SO_3H$, —COOH and not containing any basic groups.

3. An electrophotographic photoreceptor as claimed in claim 1, wherein said resin (A) has a weight average molecular weight of from $1\times10^3$ to $1.5\times10^4$ and said binder resin further contains (C) a resin having a weight average molecular weight of from $1\times10^4$ to $5\times10^5$ and containing from 0.05 to 15% by weight of at least one kind of functional group selected from the group consisting of —OH and a basic group.

4. An electrophotographic photoreceptor as claimed in claim 1, wherein said resin (A) has a weight average molecular weight of from $1\times10^3$ to $1.5\times10^4$ and said binder resin further contains (D) a resin having a weight average molecular weight of from $1\times10^4$ to $5\times10^5$ and containing from 0.05 to 5% by weight of at least one of kind of acidic group selected from the group consisting of $-PO_3H_2$, $-SO_3H$, —COOH, and

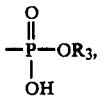

wherein $R_3$ represents a hydrocarbon group, said acidic group having a higher pKa value than that of the acidic group contained in the resin (A).

5. An electrophotographic photoreceptor as claimed in claim 1, wherein said resin has a glass transition point between −10° and 100° C.

6. An electrophotographic photoreceptor as claimed in claim 1, wherein said resin includes (meth)acrylate homo- or copolymers containing 30% or more by weight of a monomer represented by formula (I):

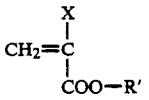

wherein X represents a hydrogen atom, a halogen atom, a cyano group or an alkyl group having from 1 to 4 carbon atoms; and R′ represents a substituted or unsubstituted alkyl group having from 1 to 18 carbon atoms, a substituted or unsubstituted alkenyl group having from 2 to 18 carbon atoms, a substituted or unsubstituted aralkyl group having from 7 to 12 carbon atoms, a substituted or unsubstituted cycloalkyl group having from 5 to 8 carbon atoms, or a substituted or unsubstituted aryl group.

7. An electrophotographic photoreceptor as claimed in claim 2, wherein resin (A) has a weight average molecular weight of from $3\times10^3$ to $1\times10^4$.

8. An electrophotographic photoreceptor as claimed in claim 2, wherein resin (B) has a weight average molecular weight of from $2\times10^4$ to $3\times10^5$.

9. An electrophotographic photoreceptor as claimed in claim 3, wherein resin (A) has a weight average molecular weight of from $3\times10^3$ to $1\times10^4$.

10. An electrophotographic photoreceptor as claimed in claim 3, wherein resin (C) has a weight average molecular weight of from $3\times10^4$ to $1\times10^5$.

11. An electrophotographic photoreceptor as claimed in claim 4, wherein resin (A) has a weight average molecular weight of from $3\times10^3$ to $1\times10^4$.

12. An electrophotographic photoreceptor as claimed in claim 4, wherein resin (D) has a weight average molecular weight of from $3\times10^4$ to $2\times10^5$.

* * * * *